United States Patent [19]

Perry et al.

[11] Patent Number: 4,488,833

[45] Date of Patent: Dec. 18, 1984

[54] RAPIDLY DEPLOYED ASSAULT VEHICLE SURFACING OR TRACKWAY SYSTEM

[75] Inventors: Robert E. Perry, Danville; William T. Myers, Jr., San Diego, both of Calif.

[73] Assignee: Kaiser Aluminum & Chemical Corporation, Oakland, Calif.

[21] Appl. No.: 372,270

[22] Filed: Apr. 27, 1982

[51] Int. Cl.[3] ..... E01C 9/08

[52] U.S. Cl. ..... 404/35; 404/41; 14/27; 52/586

[58] Field of Search ..... 404/35, 36, 37, 41, 404/32, 73; 14/27, 2.4, 2.6; 414/203; 52/177, 586, 403

[56] References Cited

U.S. PATENT DOCUMENTS

| | | | |
|---|---|---|---|
| Re. 27,147 | 6/1971 | Harvey | 404/35 |
| 2,384,395 | 9/1945 | Payne | 404/73 |
| 3,301,147 | 1/1967 | Clayton et al. | 404/35 |
| 3,348,459 | 10/1967 | Harvey | 404/35 |
| 3,557,670 | 1/1971 | Sutton | 404/35 |
| 3,572,224 | 3/1971 | Perry | 404/41 X |
| 3,592,289 | 7/1971 | Aysta et al. | 52/586 X |
| 3,613,139 | 10/1971 | Hansgen et al. | 14/2.6 |
| 3,784,312 | 1/1974 | Gordon | 404/35 |
| 3,840,308 | 10/1974 | Glaza | 404/35 |
| 4,145,786 | 3/1979 | Myers | 14/27 |
| 4,277,201 | 7/1981 | Abell | 404/99 X |
| 4,370,088 | 1/1983 | McShane | 414/529 X |
| 4,376,596 | 3/1983 | Green | 404/35 |

FOREIGN PATENT DOCUMENTS 2658900 6/1976 Fed. Rep. of Germany .

OTHER PUBLICATIONS

"Assault Trackway Systems, Activ Project No. ACL 28/68I" Feb. 13, 1968, Department of the Army, Army Concept Team in Vietnam.

*Primary Examiner*—Stephen J. Novosad
*Assistant Examiner*—Beverly E. Hjorth
*Attorney, Agent, or Firm*—Malcolm McQuarrie

[57] ABSTRACT

A transportable modular assault vehicle water egress and bridge access/egress surfacing or trackway system wherein a plurality of rectangularly shaped planks or sections are joined by flexible hinge members and can be folded accordion fashion and suspended in a container for storing, transporting and rapidly deploying to provide a surfacing upon the shores or banks of bodies of water for the access and egress of military vehicles into and out of bodies of water during military operations.

5 Claims, 19 Drawing Figures

RAPIDLY DEPLOYED ASSAULT VEHICLE SURFACING OR TRACKWAY SYSTEM

BACKGROUND OF THE INVENTION

This invention relates to a novel load-supporting plank system that is particularly adapted for being rapidly deployed for the stream egress and bridge access/egress of military vehicles wherein improved means are provided for joining the individual planks to each other in a manner that water and mud penetration at the joints is effectively prohibited. The invention comprises a system of a plurality of planks joined together in an articulable fashion by flexible hinge members in such a way that the system may be folded in accordion or fan fashion that permits efficient packing in a container for transport and for rapid deployment. In one embodiment of the invention the planks are hollow extrusions of aluminum alloy fitted with end plugs, thereby permitting the system to be floatable. However, the plugs are easily removed, and the system, or a portion of the system if desired, becomes sinkable. The planks are folded in accordion fashion and packed in a pallet which preferably is constructed of closed tubular members, and therefore also floatable in water. The pallet is designed to be suspended in front of a deployment vehicle, and the planks are so deployed that the vehicle rides upon the surface of the plank members of the system as the planks are withdrawn from the pallet. Further, the palletized planks may be deployed by other means, such as being manually levered from the pallet while the pallet is resting on the stream shore, and the surfacing will then float away from the pallet. Further embodiments of the invention include planks having a honeycomb core structure and also planks which utilize foam plastic instead of extrusions of aluminum. These embodiments are not sinkable.

The prior art discloses various transportable roadway systems used for military assault purposes in order that the vehicles may traverse soft, swampy, or sandy ground. Paradigms of these are disclosed in Payne U.S. Pat. No. 2,384,395, Abell U.S. Pat. No. 4,277,201, German patent application, Offenlegenschrift No. 2,658,900, and the technical report distributed by Defense Technical Information Center entitled "Assault Trackway Systems Activ Project No. ACL 28/681", Feb. 13, 1969.

The Payne patent discloses a vehicle which is modified to lay wire mesh mats to be used as a landing field, beach apron, temporary road or the like. The Abell patent discloses a transportable roadway system which is loaded on a transport vehicle by folding the roadway layer upon layer and is comprised of a plurality of sections, each section including a plurality of planks positioned edge to edge and bonded by a flexible membrane or fabric, and the adjoining sections are connected by hinges connecting the end planks of each section. The roadway system can be deployed from either the rear of the transporter vehicle or over the front of the vehicle. Offenlegenschrift No. 2,658,900 also discloses a roadway system wherein the planks can be deployed from the rear of the transporting vehicle or over the front of the transporting vehicle. The planks in this case are folded accordion-fashion for transport. The report distributed by Defense Technical Information Center discloses roadway systems that were experimental with in Viet Nam. Two trackway systems are described, one of aluminum extrusions and the other of plastic. In the case of the aluminum trackway, the trackway was dispensed from a spool upon which it was wound, the spool being mounted upon a truck. The trackway is dispensed by rolling it forward over the cab of the truck and under the front and rear wheels. In the case of the plastic trackway, the trackway was dispensed from a reel mounted on the front bumper of a vehicle.

In each of the aforementioned prior art roadway systems there are deficiencies, and there would be serious difficulties in deploying these in an assault egress and bridge access/egress system.

SUMMARY OF INVENTION

Accordingly, it is the primary purpose of this invention to provide a novel, improved transportable modular assault egress and bridge access/egress surfacing or trackway system which is comprised of a plurality of rectangularly shaped planks, the edge of one of the long sides or dimensions of the rectangularly shaped plank members is provided with an elongated tongue member, while the edge of the other of said long sides is provided with a female portion which is interengageable with the tongue member of the adjacent or contiguous plank member. Flexible hinge members join adjacent plank members in order that the plurality of planks of the surfacing may be folded accordion or fan style. A flexible hinge member is adapted to be readily connectible to said adjacent planks when the planks lie in intersecting planes while the hinge members will prevent the penetration of water in either direction and prevent the pumping of mud during traverse of the surfacing by vehicles when the planks lie in substantially the same plane. The mud pumping would be caused by penetration of water through the joints of the system or the presence of water in the soil beneath the system, thereby causing a hydraulic or pumping action forcing soil out from under the system through the joints when the surfacing system is traversed by vehicles. One advantageous embodiment of the invention is a plurality of planks formed of aluminum extrusion sections wherein parallel hollow conduit portions extend the length of the long dimension of the rectangularly shaped planks, the surfacing being either floatable or sinkable, depending upon the use of suitable removable plug or sealing members for plugging the parallel hollow conduit portions, and a floatable tubular pallet member for storing and transporting the surfacing, while the planks are in a folded manner in a locked position, as well as means for unlocking said surfacing and rapidly deploying said plurality of planks of said surfacing. Other embodiments of the invention concern the use of a honeycomb core construction or a foamed plastic for the body of the rectangularly shaped planks. These embodiments are floatable and would be suitable for access roadways.

BRIEF DESCRIPTION OF THE DRAWINGS

The invention will be further understood, and the advantages thereof will become more apparent from the ensuing detailed description when taken in conjunction with the appended drawings wherein:

FIG. 6 is a sketch of a track vehicle transporting the tubular pallet and the surfacing of the invention and deploying the surfacing from said pallet during the egress movement from a body of water, such as a stream, river, or the like.

FIG. 7A is a plan view of the closure while FIG. 7B is a side elevational view.

DETAILED DESCRIPTION OF THE INVENTION

With reference to the drawings which are for the purpose of illustrating rather than limiting the invention, there are shown the salient features of the transportable and rapidly deployable modular assault vehicle egress and bridge access/egress surfacing system of the invention.

Figure 1:
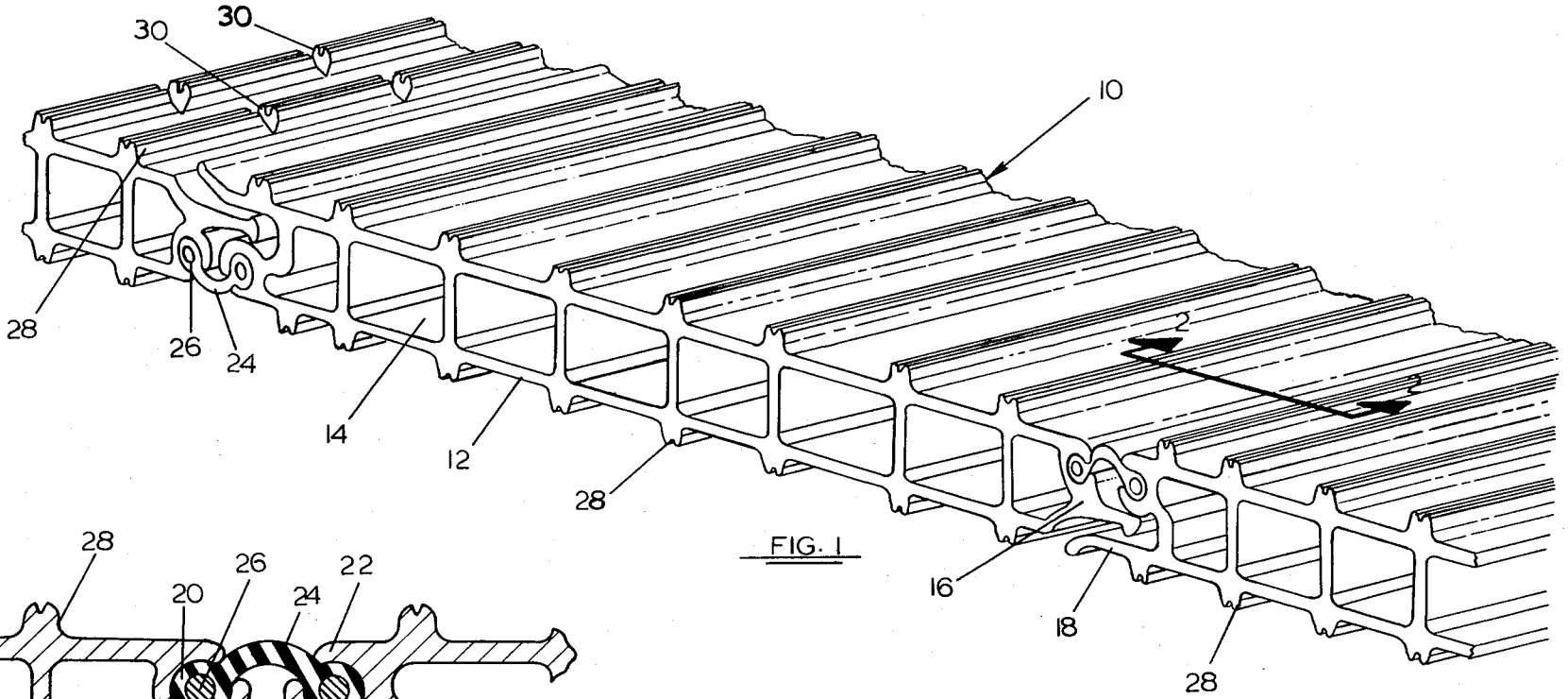
FIG. 1 is a partial perspective view of the surfacing while in its laid-out extended position.
Figure 2:
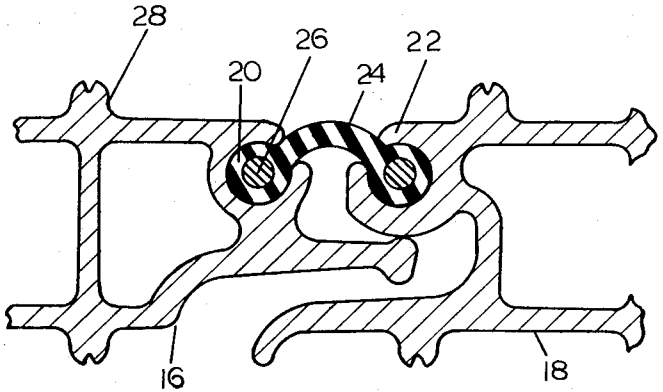
FIG. 2 is a transverse sectional view taken along the lines 2—2 of FIG. 1 showing the joining of adjacent planks.
Figure 3:
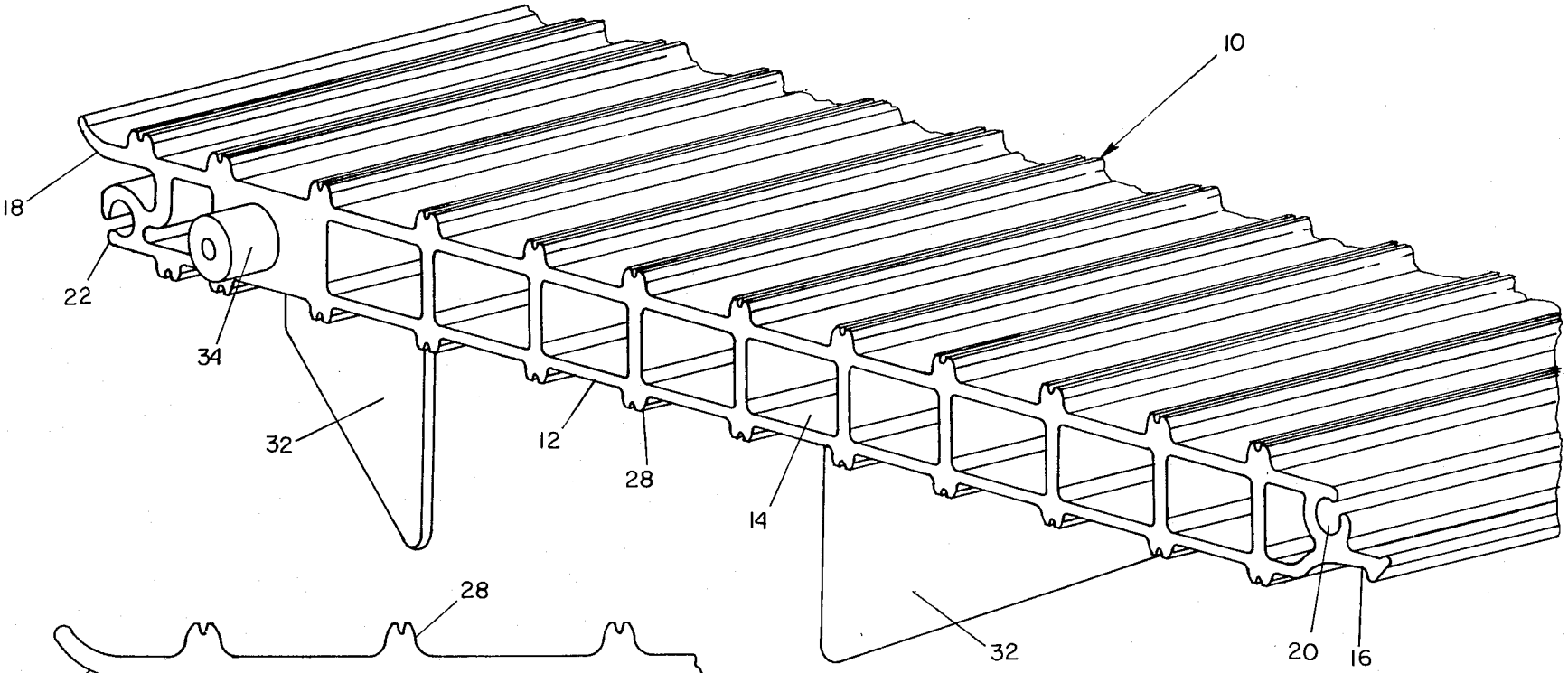
FIG. 3 is a partial perspective view of the surfacing system showing the features of the plank on each end of the surfacing.
Figure 4:
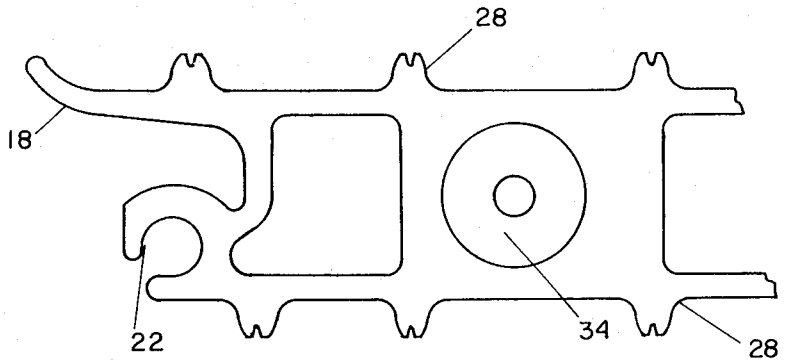
FIG. 4 is a partial elevational view of a plank showing the details of the female portion of a plank edge and the means for supporting the planks when in the folded and packed position.
Figure 5:
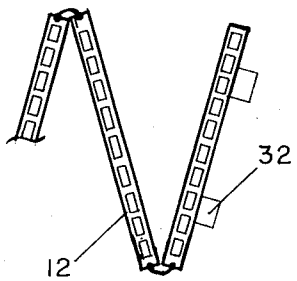
FIG. 5 is a diagrammatic sketch showing the folding features of the surfacing.

With particular reference to FIGS. 1–5, inclusive, there is shown one embodiment of the invention wherein the surfacing system 10 is comprised of a plurality of planks 12, which are made from an aluminum alloy extrusion, which is provided with a plurality of hollow conduit sections 14. A suitable aluminum alloy composition for this application is 6061 in the T6 temper. Each extruded plank 12 on the edge of the long side or dimension thereof is provided with a male or tongue portion 16, while the edge of the other long side of said elongated plank member 12 is provided with a female portion 18. The male portion 16 of plank member 12 is interengageable with the female member of an adjacent plank. Flexible hinge members 24 which are made of a mildew and weather resistant synthetic elastomer fabric base joins the adjacent plank members through the bulb members 26 on the hinge member, one of the bulb members passing through the passage 20 on the male portion of a plank, while the other of the bulb members passes through passage 22 on the female portion of the adjacent plank. Hinge members 24 are alternately on the top and bottom surfaces of the surfacing system 10, thereby permitting the surfacing system 10 to be folded accordion (fan) fashion as shown in FIG. 5 for storing, transporting and dispensing. The bulb members of hinge members 24 are readily installed in passages 20 and 22 when the adjacent planks to be joined lie in intersecting planes. After installation of the hinge member and the joined, adjacent planks are placed in substantially the same plane, the hinge member prevents the penetration of water in either direction, and the pumping of mud during the traversing by vehicles. Extruded rib members 28 are integral with the bottom and top surfaces of the plank members and may be notched or cross-cut with grooves 30, as shown, for exemplary purposes, in some of the ribs 28 of FIG. 1 for ensuring traction of the vehicles. Spades 32, as shown in FIGS. 3 and 5, are provided at the leading plank section and the ending plank section of the surfacing system 10. The spades 32 are oriented to provide lateral and horizontal resistance when embedded in the subsoil and are adapted to collapse if the system at the end sections is placed on very solid ground, such as hardpan. Also provided on the surfacing system 10 are support lugs 34, shown in FIGS. 3 and 4, which provide support for the surfacing system 10 during storing, transporting and dispensing.

Figure 13:
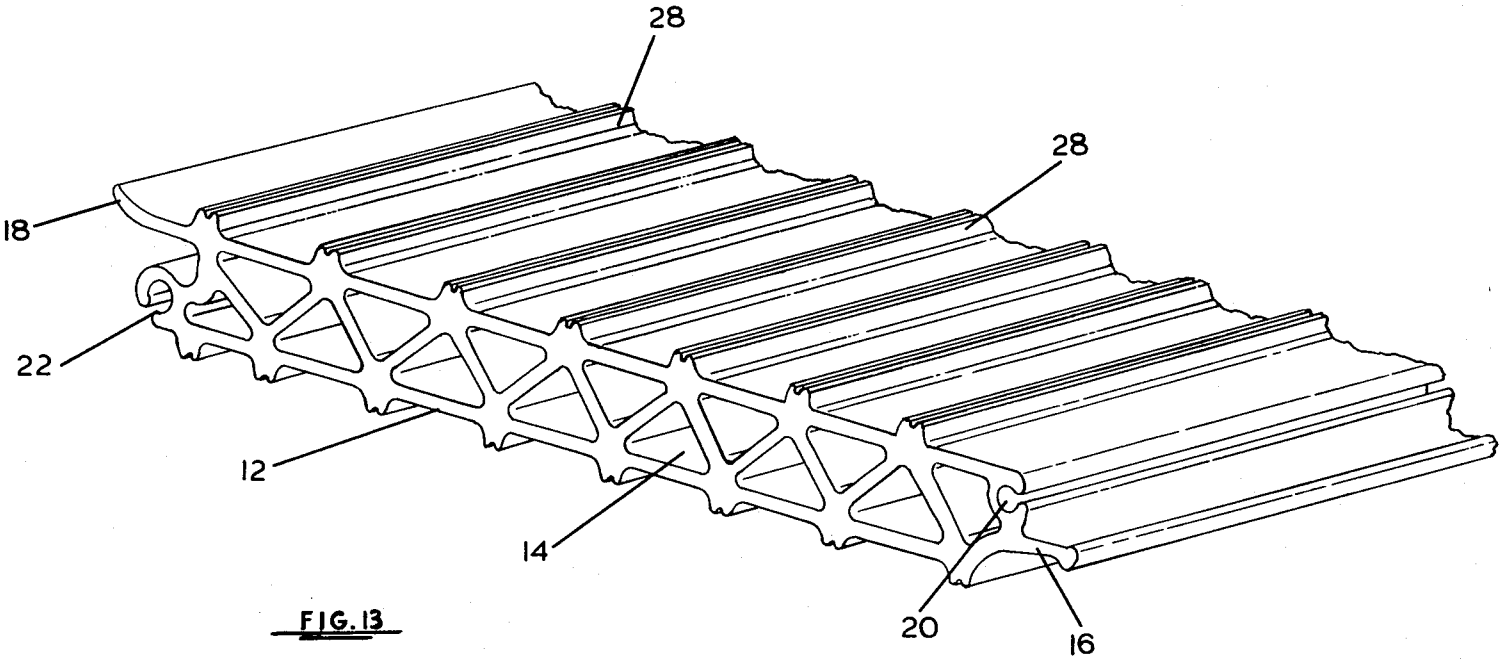
FIG. 13 is a partial perspective view of a plank member showing a variation in the structure of the extruded plank from that shown in FIGS. 1 and 3.

FIG. 13 shows a modified plank 12 of an aluminum extrusion. The essential distinction between the plank of FIG. 13 and that shown in FIGS. 1 and 3 is that the hollow conduits of FIG. 13 are triangular in cross section rather than rectangular. The triangular webs of the plank 12 of FIG. 13 render the plank more resistant to bending across the transverse dimension of the plank than the plank 12 of FIGS. 1 and 3.

Figure 6:
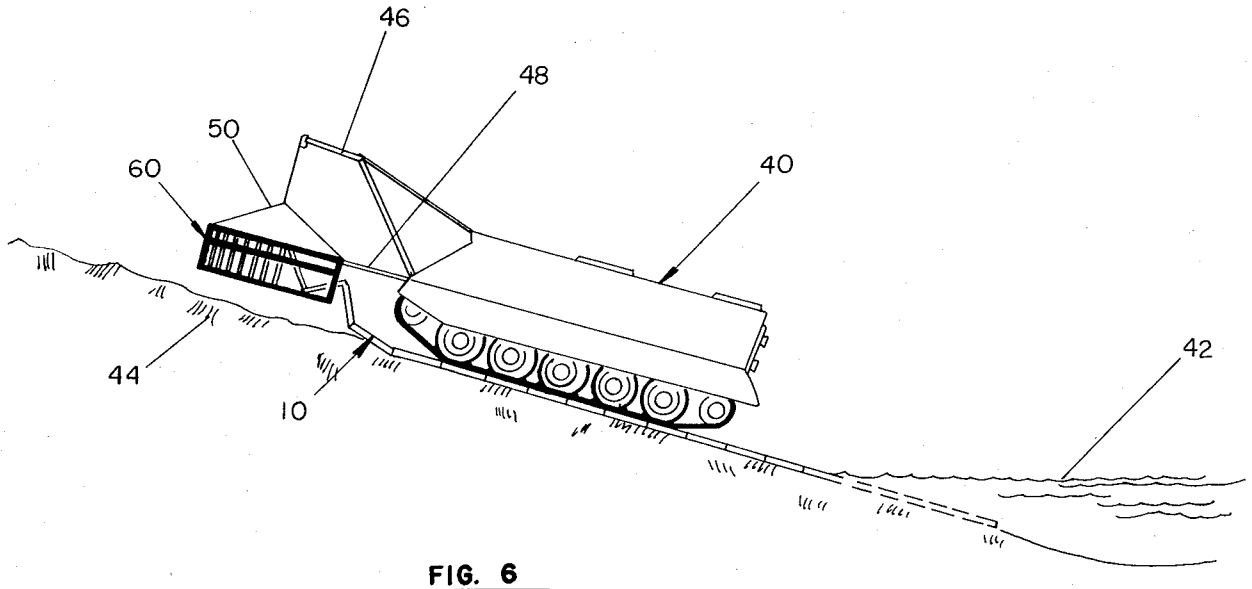

FIG. 6 is a schematic drawing showing an assault vehicle 40 egressing from a stream 42 while laying the surfacing system 10 upon a bank 44. A tubular pallet 60 is transported by the assault vehicle 40 by means of A-frame 46 mounted on the assault vehicle 40 and a sling 50. A bar member 48 prevents the pallet from swinging into the assault vehicle 40 and also keeps the orientation of the tubular pallet member 60 in the proper position for dispensing the surfacing or trackway system 10.

When the assault vehicle 40 emerges from the stream 42, a large quantity of water is carried up by the tracks and that, together with the water pumped from the bilge, will render unserviceable for continuous traffic a water-permeable ramp or trackway. The flexible hinge members 24 prevent water from penetrating through the surfacing system 10 to the soil of the bank 44, thereby preventing water from settling under the planks 12. In the case of a saturated subsoil, it prevents a hydraulic pumping action that forces a mud slurry up from under the planks 12 and through the joints during the traverse of the assault vehicle 40. The waterproofing prevents the California Bearing Ratio (CBR), hereinafter defined, from being reduced, the subgrade from being excavated by water erosion and the soil from being displaced after being softened by water intrusion.

The surfacing system 10 may be of any suitable number of plank members 12; for example, a typical surfacing system for egressing from a stream would be one of about 50 or more feet in length. The width of the surfacing 10 (length of a plank 12) may be, for example, 10 to 20 feet. The plank width may vary from about 1 foot to 4 feet. The wider surfacing would be used for handling the heaviest vehicles, such as the heavy assault tanks which may have a gross weight of 80 short tons or more.

Figure 7A:
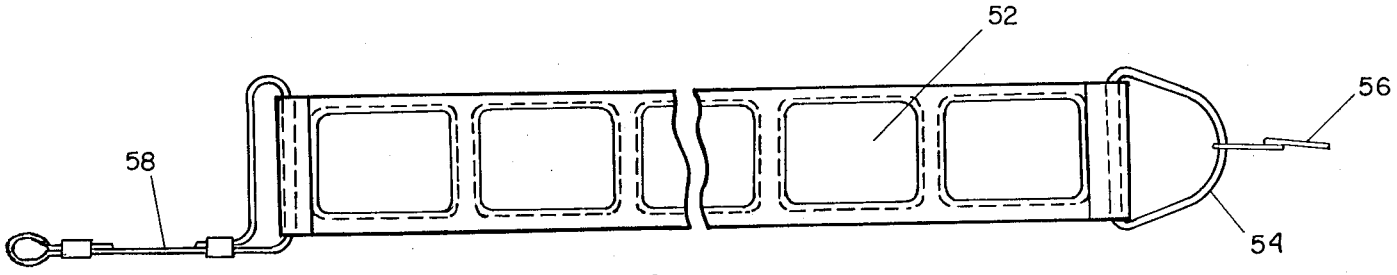
FIGS. 7A and 7B show a removable plug closure for closing the ends of the hollow conduits of the extruded planks.
Figure 7B:
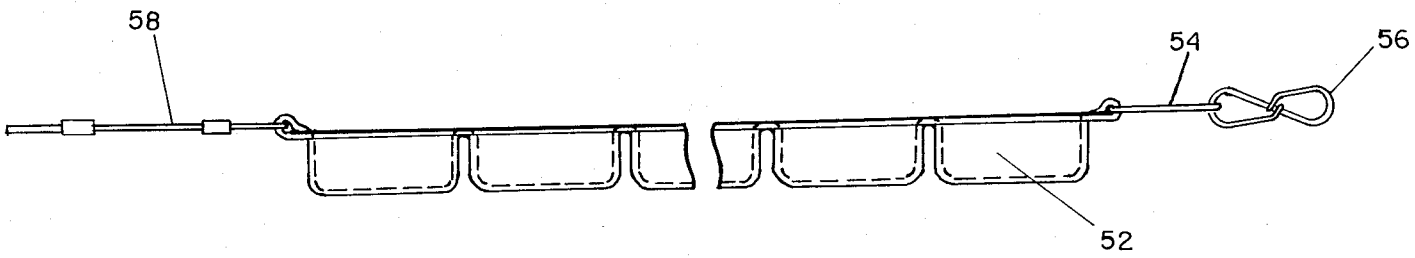

FIGS. 7A and 7B disclose a closure 52 which is of a configuration that may be used to plug the open ends of the hollow conduits 14 of the extruded plank members 12. The closure 52 may be made from either plastic or rubber, and a sealant may be used for ensuring an adequate plugging of the hollow conduits 14. The closure is made to conform to the end configuration of a single plank member 12. The hollow conduits adjacent the male portion or end 16, and the female portion or end 18 of a plank 12 may be permanently sealed, in which case the closure 52 would be of a length to plug the balance of the hollow conduits 14. Also, the closure 52 is designed to accommodate the support lugs 34. On one end of the closure member 52 is a wire with a spring lock attached thereto while the other end has joined thereon a flexible metal cable 58 with a loop formed at the end thereof. The closure members 52, when installed on the plank members, are interconnected with the adjacent closure members through means of the bail 54 and spring lock 56 being connected to the flexible steel cable 58 of the adjacent closure member of the adjacent plank member 12. When the closure members 52 are in place, the surfacing or trackway system 10 will float, and when the closure members 52 are removed by pulling a suitable lanyard (not shown), the interconnected closures 52 will be progressively stripped, and the surfacing or trackway system 10 will sink. It is obvious that only a portion of the interconnected closure units may be stripped if it is desired that only a partial portion of the surfacing or trackway system 10 sinks into the water.

Figure 9:
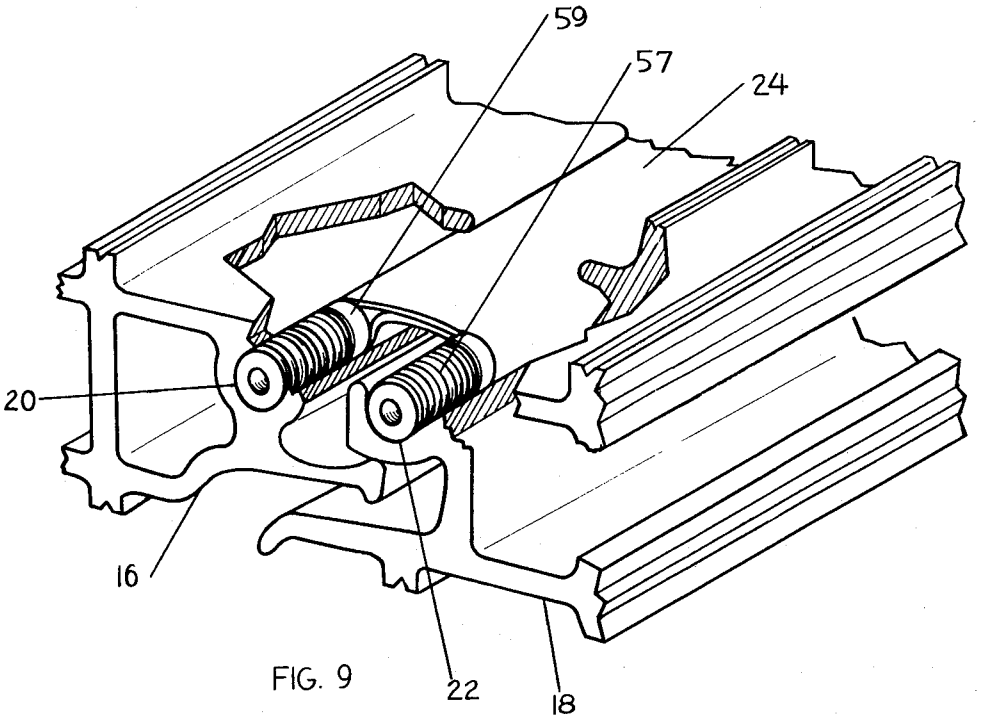
FIG. 9 is a fragmentary perspective view showing the means of FIG. 8 in more detail.
Figure 8:
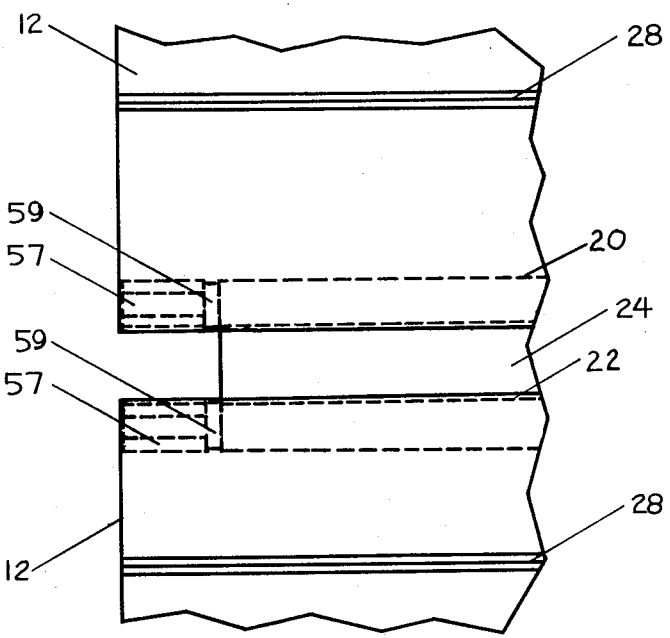
FIG. 8 is a partial top plan view of a joint between adjacent plank members showing one means for preventing the lateral shifting of planks or the relative lateral movement between planks while joined in the surfacing system or roadway.

FIG. 8, which is a partial top plan view of adjacent plank members 12, and FIG. 9, which is a partial perspective view with portions cut away, show one means to prevent the lateral shifting between planks 12 when assembled in the surfacing or trackway system. As shown in FIGS. 8 and 9, hinge retainers 57 are inserted into passages 20 and 22 of the male and female portions of adjacent planks 12 after the bulbs 26 of hinge member 24 have been inserted in said passages. The hinge retainers may be steel, self-tapping (threaded) hollow inserts which are threaded into the passages. Prior to insertion into a passage, a metal disk 59, preferably of aluminum, is inserted in the passage in a manner to abut a bulb 26 of a hinge member 24. As the hinge retainers 57 are rather short in length, on the order of ⅝ inch, for example, the hinge member 24 need not be shortened to accommodate the hinge retainers. Inserting the hinge retainers 57 at each end of a passage 20 or 22 will compress, to a small extent, the hinge member 24. The simplicity of this means for preventing the lateral shifting between adjacent plank members is an important feature for the ease of replacement of hinge members in the field.

Figure 10:
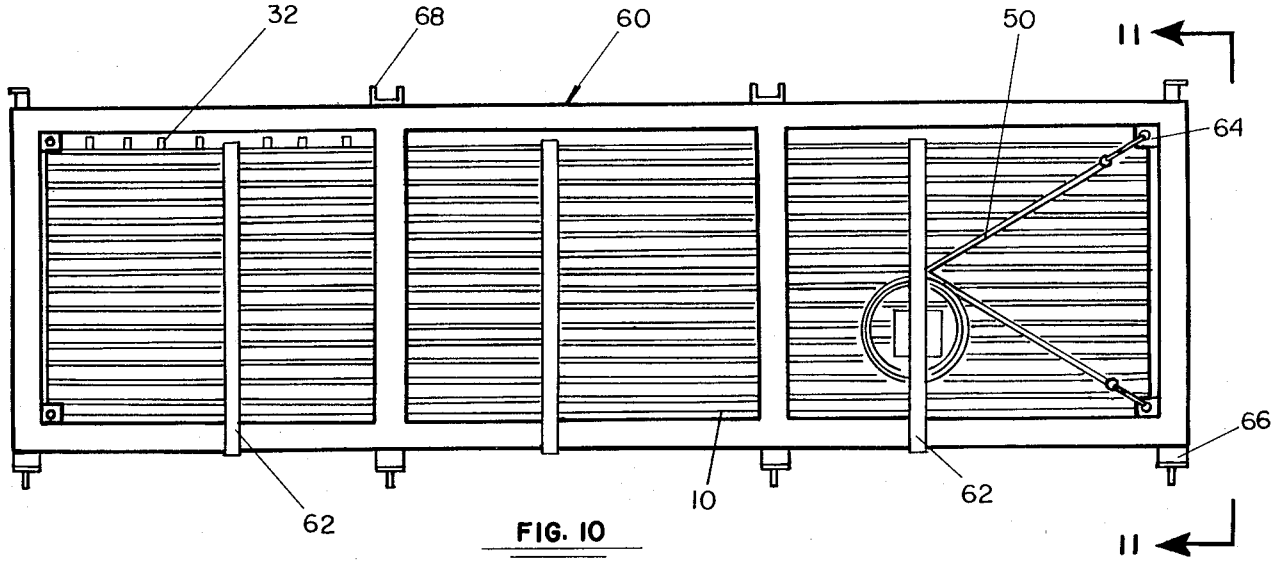
FIG. 10 is a top plan view of the tubular pallet member for storing, transporting, and deploying the surfacing.
Figure 11:
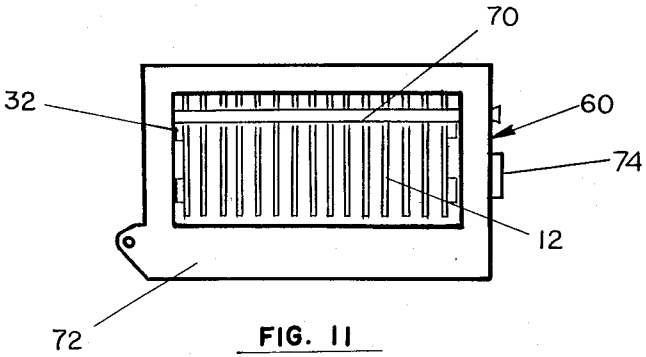
FIG. 11 is an end elevational view of the tubular pallet member taken along the lines 11—11 of FIG. 10.

FIG. 10 is a top plan view of the tubular pallet 60, and FIG. 11 is an end elevational view of the pallet. The tubular pallet 60 is a tubular aluminum framework, which is designed as a shipping, transporting and dispensing container from which the surfacing or trackway system 10 may be quickly deployed. Being of tubular structure, the pallet 60 will float in the water, and provides a stable structure to contain the surfacing or trackway system 10. In FIG. 10, there is shown the surfacing or trackway system 10 in its accordion-fashion, folded and packed position in the tubular pallet 60. Banding straps 62 hold the folded surfacing system 10 in position. In the transporting position, the sling member 50 is shown in a packed position. For the lifting of the tubular pallet 60, the ends of the sling 50 are deployed into pad eyes 64, which are located at the corners of the pallet as shown in FIG. 10. The pad eyes 64 are for lifting the pallet in its position for deploying of the surfacing 10.

Pad eyes 66 are located on the side of the pallet 60 in order that the pallet may be lifted from that side in order to pick up for repacking the surfacing 10. This feature is important to allow repackaging for use at a different site and will be described later. Struts 68 are located on the open side of the pallet 60, that is, the side from which the surfacing or trackway system 10 is deployed. The struts 68, which are fastened to the tubular pallet 60 by suitable means, such as bolts (not shown), reinforce the inboard frames of the pallet 60 to resist loads imposed on the pallet when pallets are stacked for storage or shipping.

FIG. 11, the end elevational view of the pallet 60, shows support rails 70, which supply the support for lugs 34 of the trackway system 10. The bottom frame of the pallet 60 is a skid 72, which permits the pallet 60 to be dragged over the ground.

Figure 12:
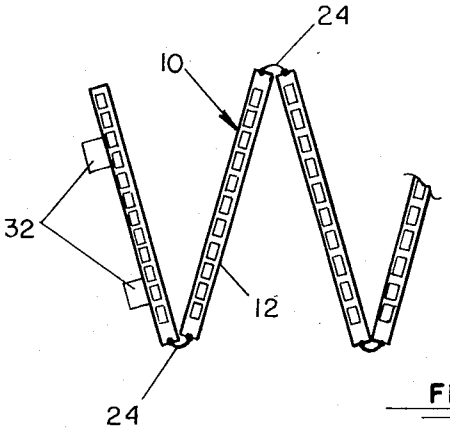
FIG. 12 shows a means for picking up the surfacing and storing it into the tubular pallet member.
Figure 12:
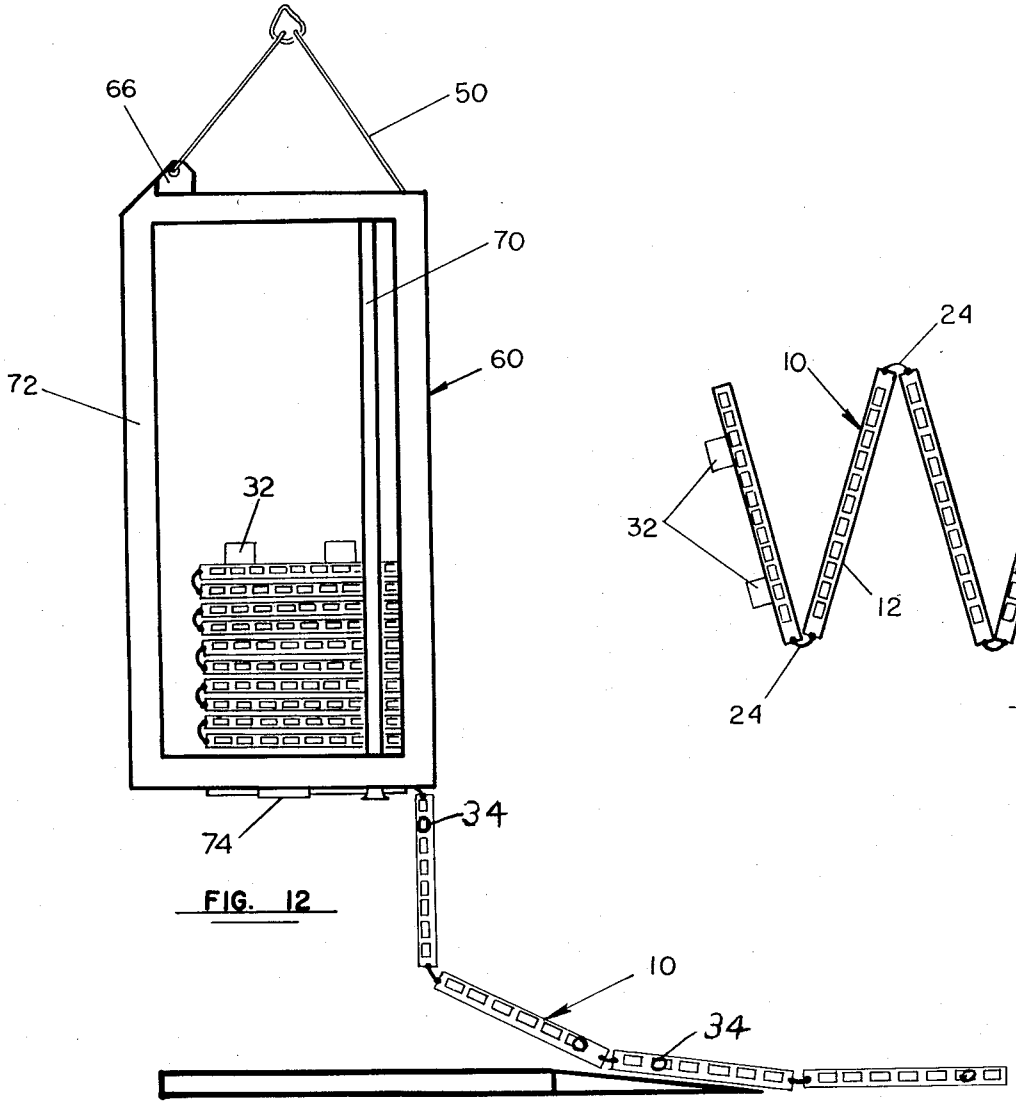

FIG. 12 is an end view of the pallet 60 similar to the view in FIG. 11 except that the orientation of the pallet is such that the pallet 60 is suspended from a side by means of pad eyes 66 in order to permit a picking up of the trackway and repacking it in the pallet 60. A suitable latch mechanism 74 is positioned at opposite ends of the pallet 60, as shown in FIG. 12, and is attached to tubular frame members of the pallet 60 by a suitable means. The latch mechanisms 74 permit the planks 12 of the surfacing or trackway system 10 to be picked up one at a time, and may be comprised of one or more spring-loaded latches permitting the latches to retract and extend as the tubular pallet 60 is moved downward to engage and pick up a plank 12 of the surfacing or trackway system 10.

In repacking the surfacing, the procedure is as follows: the anchor or lead plank is folded back over the adjacent plank of the surfacing or trackway system. The struts 68 are removed from the pallet 60. The hoisting sling 50 is attached to the side of the tubular pallet 60, and the pallet is hoisted up and is positioned above the folded-back anchor plank so that the support rails 70 of the pallet 60 are aligned with the support lugs 34 on the anchor plank. The latch mechanisms 74 are released to permit the latches to extend. The pallet 60 is lowered and the support rails 70 are guided to slide around the lugs 34 on the planks 10. The latches will engage the ends of the planks 12. The ground may prevent the latch members 74 from engaging the planks; in this event, the pallet 60 is lifted, which, in turn, lifts the planks so that suitable blocks can be placed beneath the planks. The pallet 60 is again lowered to engage the next plank with the latch mechanism 74. By moving the hoisting system and lifting the pallet 60 and engaging and lifting the planks 12 in succession while guiding the support rails 70 around the support lugs 34 on the planks, the balance of the planks can be picked up and stored in the pallet 60 by lowering the loaded pallet 60 over suitable blocks, the loaded planks 12 can be pushed to the back of the pallet 60 where they can be secured with banding straps, such as banding straps 62 of FIG. 10, to make the package secure for transport. During the pickup procedure, the dirt that may adhere to the planks should be scraped off to prevent binding as the planks are folded into the stored position. The strut members 68 are replaced on the pallet and the latches are locked in the retracted position to make the pallet 60 ready for transport and deployment.

Figure 15:
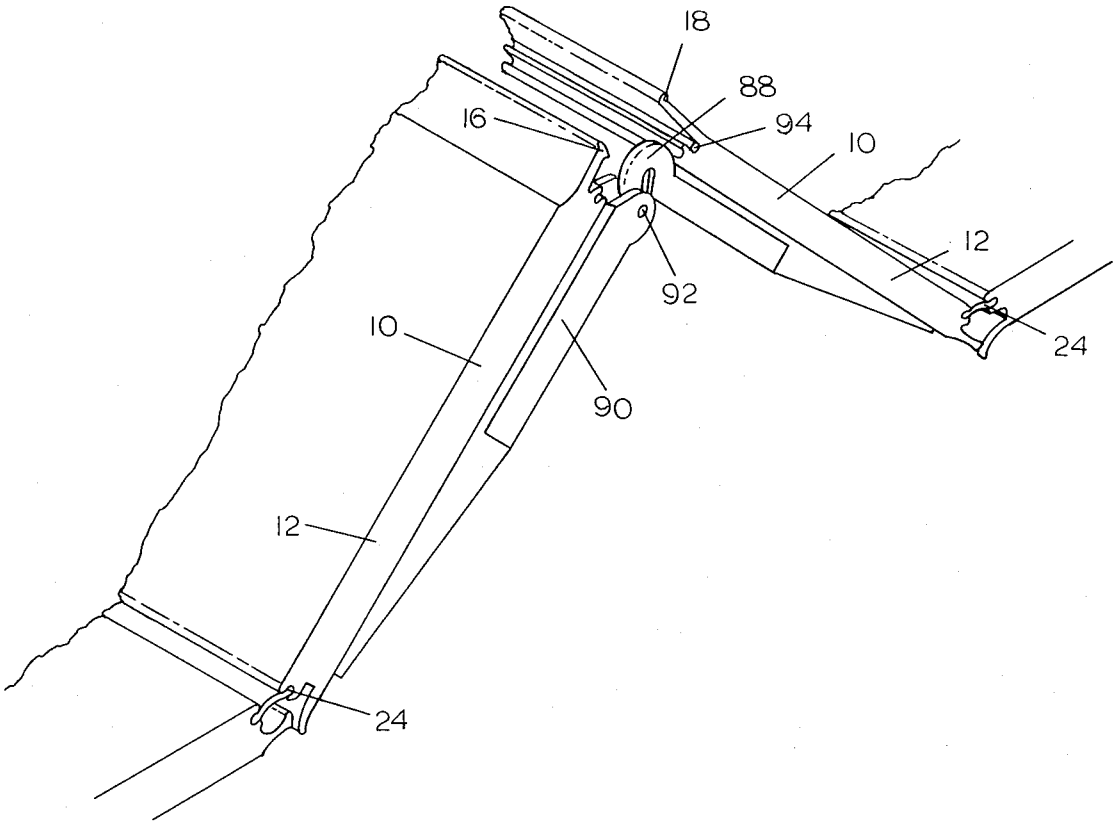
FIG. 15 is a partial perspective view depicting a scheme for joining the ends of two sections of surfacing, in a joint that will prevent both the penetration of water and the pumping of mud.

In certain instances, auxiliary anchoring of the surfacing system 10, in addition to the spades 32 as shown in FIGS. 3 and 5, may be required. Suitable means, such as, steel hooks 88 and the member 90 of FIG. 15, are provided to serve as anchor points. Steel cables engaging said hooks 88 and members 90 and also engaging a suitable anchor (a tree or even an assault vehicle) would provide the additional anchoring of the surfacing system.

The surfacing system of the invention is very effective in soft or muddy ground, such as is found in the banks of some rivers. The surfacing system is designed to efficiently support heavy vehicles over ground that has a CBR (California Bearing Ratio) of 1 or 2. The California Bearing Ratio is a scale for measuring the bearing strength of ground, ranging from 1 for very muddy, soft, soil to 100 for compacted crushed rock. (California Bearing Ratio is defined in "Soil Mechanics, Foundations, and Earth Structures" by Gregory P. Tschebotarioff, 1951, McGraw-Hill Book Company, Inc.)

The aluminum surfaces of the surfacing or trackway may be coated with a suitable nonskid paint for traction, as well as camouflage, and the other aluminum surfaces of the system, such as the pallet, may be coated with a paint of a suitable color for camouflage purposes. In order to ensure adherence of the paint coating to the aluminum surfaces, a suitable precoating procedure, such as a chemical coating, or caustic etching, would be required. Also, if desired, the finish coating may be anodizing of a suitable color.

An important feature of the surfacing system 10 is that the adjacent planks 12 are joined along their long edges or sides by means of interengageable male and female portions, numbers 16 and 18, respectively, in FIGS. 1 and 2, and flexible hinge members 24. The position of the flexible hinges alternates from. the top to.the bottom of the surfacing on successive planks. This allows both tension loads and vertical shear loads to be reacted by adjacent planks. Further, the locks which are provided to prevent shifting or lateral movement between adjacent planks 12, as shown in FIGS. 8 and 9, do not affect the articulation of the joints.

The joints between adjacent plank members 12 permit rotation of up to about 15° upward and up to about 15° downward while continuing to transfer shear between planks. Further, the grooves or passages 20 and 22 for the bulb ends of the hinge members 24 are designed to carry the tension loads developed when heavy vehicles traverse steep slopes over weak subgrades.

Figure 14:
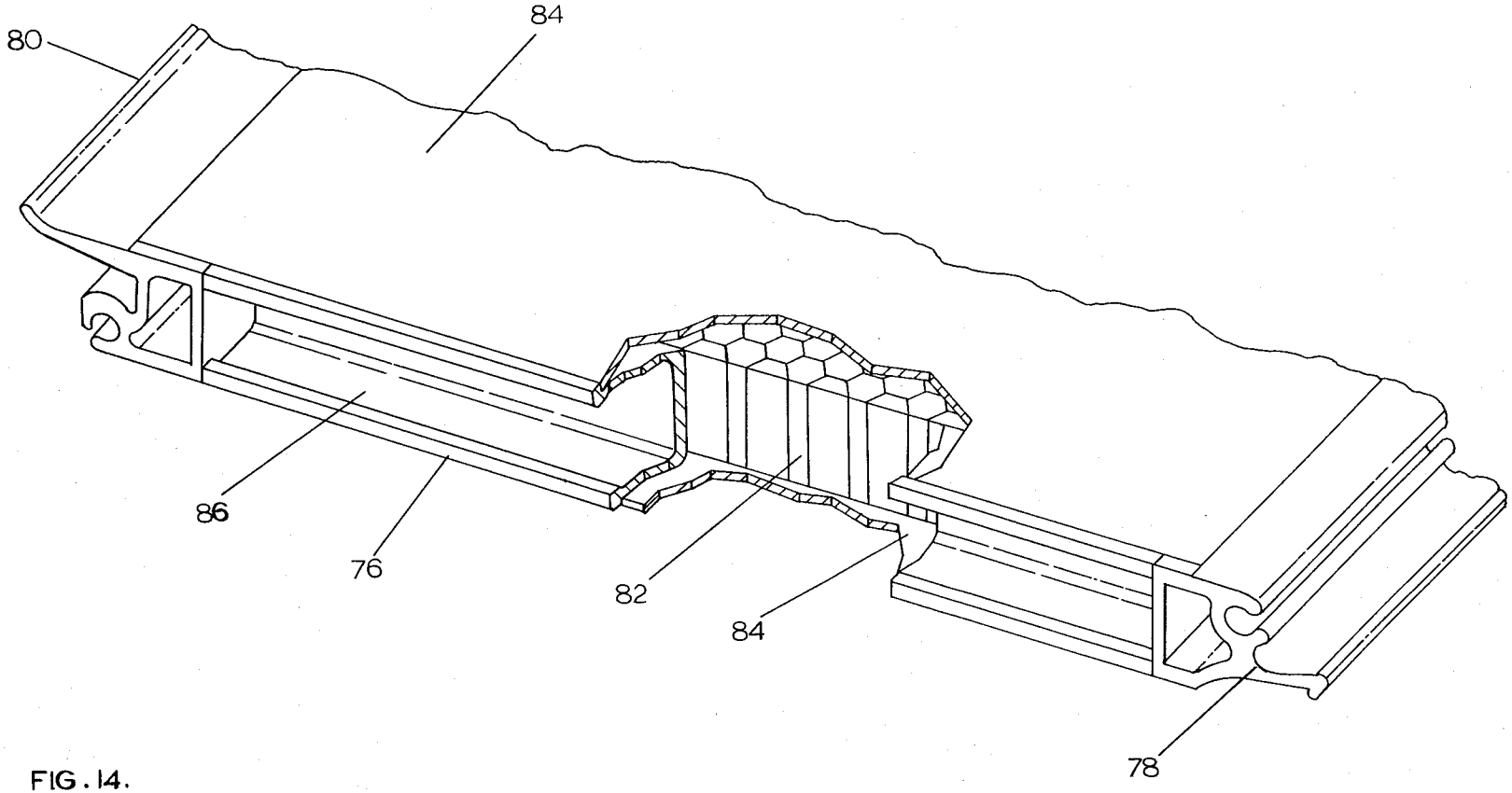
FIG. 14 is a partial perspective view, with a cut-away section, showing a modified plank member wherein the body of the plank is of honeycomb core construction.

FIG. 14 is a perspective view, with portions cut away, of a plank employing an adhesively bonded construction with a honeycomb core, extruded edges and face sheets, all of which are of aluminum alloy. The plank or panel, which is considerably lighter than the plank made from aluminum extrusions, is buoyant in water and will not sink. Thus, it would not be applicable for use in a stream egress application, but it would have a distinct weight advantage over the extruded plank for the bridge access/egress role. In the embodiment shown in FIG. 14, the bonded plank 76 is comprised of an extruded aluminum male portion 78, and an extruded aluminum female portion 80, together with a honeycomb core 82, which is sandwiched in between aluminum alloy sheets 84. Siderails 86 would extend along the outer surfaces between the extruded male portion 78 and the extruded female portion 80. The honeycomb material 82 is advantageously of an aluminum alloy, and is adhesively bonded, with a suitable adhesive, to the metal sheets 84, siderails 86, male portion 78, and the female portion 80. Also, plastic foam could be the core material.

In FIG. 15, there is shown a scheme for joining the end planks or modules of two sections of the surfacing in order to extend the length of the surfacing wherein provisions are made to prevent water penetration and mud pumping through the joint between the two sections. In this embodiment, the lead plank 12 of the section has welded thereto, on each side of the bottom of the plank, hooks 88, which are placed at each side of the female portion 18 of the plank. On the end of the section ahead of the first-mentioned section, there is welded on the bottom of the last plank 12, on both sides thereof, a member 90, which has thereon a pin 92. When hooks 88 engage pins 92, and the planks 12 are rotated to fully engage, the male portion 16 is pressed against the seal member 94, which is affixed in the bottom of the groove of the female portion 18. A suitable sealing member may be a rubber tubular member having a plastic foam material inside the tube. This will preclude the penetration of water and also the pumping of mud.

Figure 16:
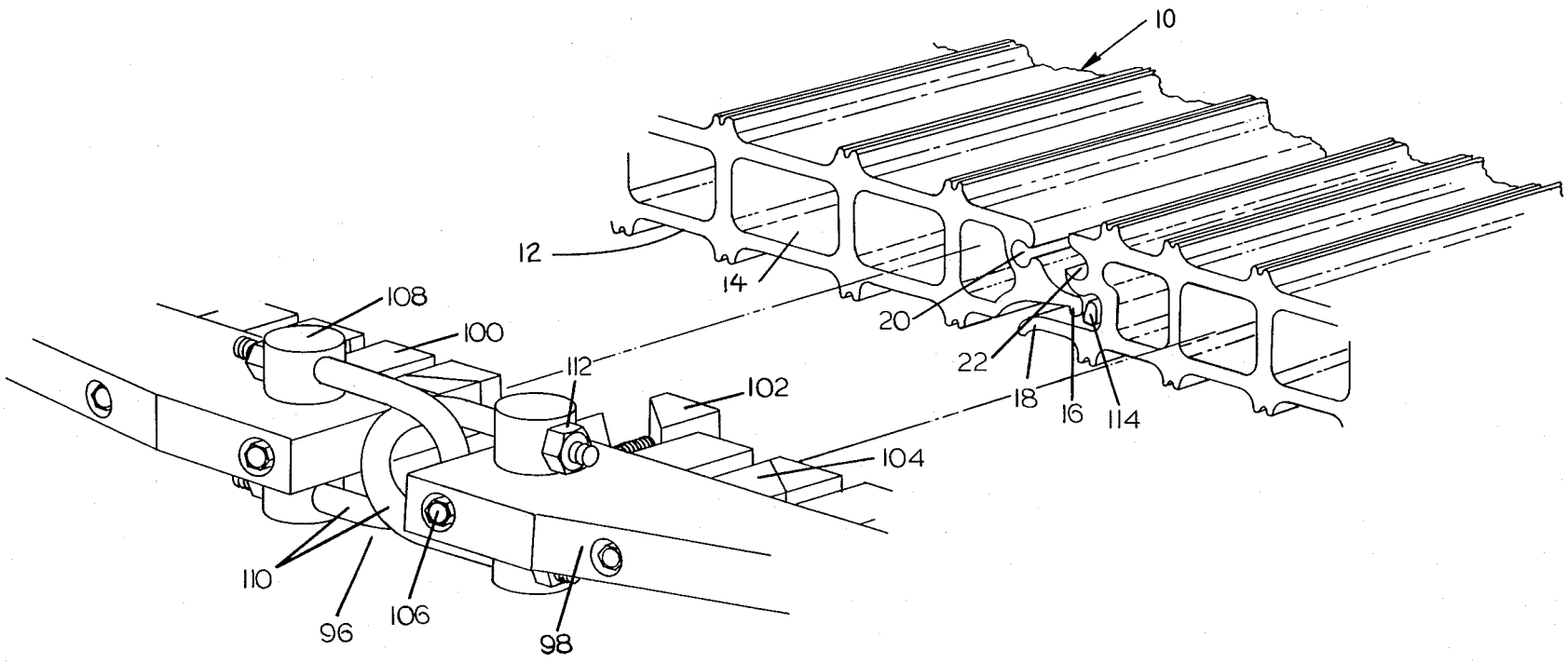
FIG. 16 is a partial perspective view, which shows a joint that can be installed in the field in instances where it is impractical to install the flexible hinge member.

FIG. 16 shows a fitting that is designed to join two planks of surfacing in situations where it is difficult or impractical to install the flex hinge. This situation would arise in the field when planks are replaced and it is impractical to orient the adjacent panels in the position required for the installation of the final connecting hinge. In the embodiment of FIG. 16, there is a fitting 96, which is comprised of two plate portions 98, which have a plurality of lugs 100 and 102 depending therefrom. The lugs 100 and 102 fit in a substantially snug manner in the hollow conduits 14 of the adjacent planks 12 to be joined. When the lugs of the plate body portions 98 are installed in the hollow conduit sections of the adjacent planks, expanding lugs 102 have a bottom portion 104 which can be tightly secured in hollow conduits 14 when the bolts 106 are tightened. Trunnions 108 are suitably attached on either side of the plate body portions 98, and have suitable holes for engaging U-bolts 110. When the U-bolts 110 are thus engaged and engage each other, as shown in the FIG. 16, the U-bolts are tightened by nuts 112, and the joint between the adjacent planks 12 will be sealed when the male portion 16 is pressed against the seal 114, which is lodged in the groove of the female portion 18 of the adjacent plank. As in the case of the embodiment shown in FIG. 15, the seal herein can be the same, that is, any suitable sealing material, such as a rubber tube having a foam center or core.

Figure 17:
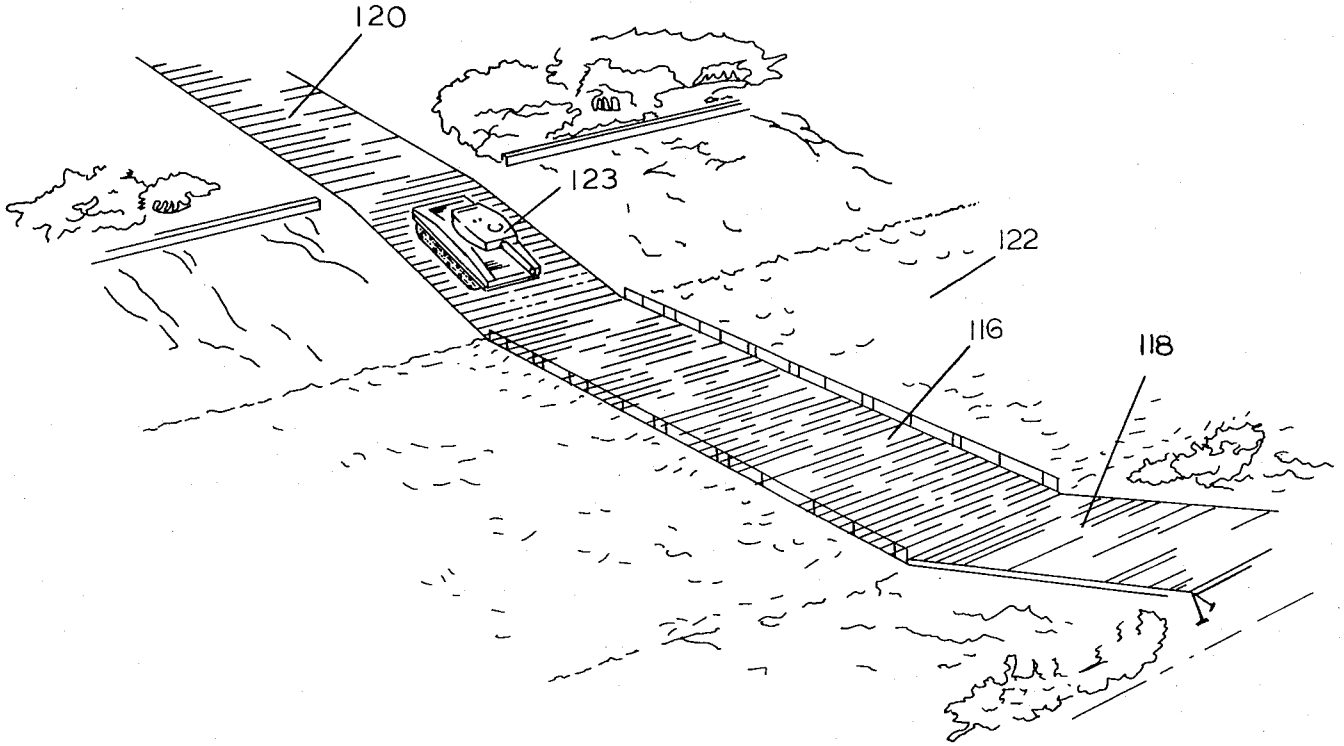
FIG. 17 is a sketch showing the surfacing of the invention used in a bridge access/egress situation.

In FIG. 17 a scheme is shown for using the surfacing of the invention in a bridge access/egress situation. In FIG. 17, which is a sketch of assault vehicles crossing a river or stream, there is shown a suitable bridge 116 deployed across the river or stream 122 by any suitable means, such as pontoons. In the foreground of the figure is an egress surfacing section 118, and on the other side of the stream is shown an access surfacing section 120. In placing the surfacing, the sequence may be the placing of the access portion 120 down to the stream, whereafter the bridge 116 can be deployed. Then the egress section 118 can be deployed from the bridge up the bank.

Figure 18:
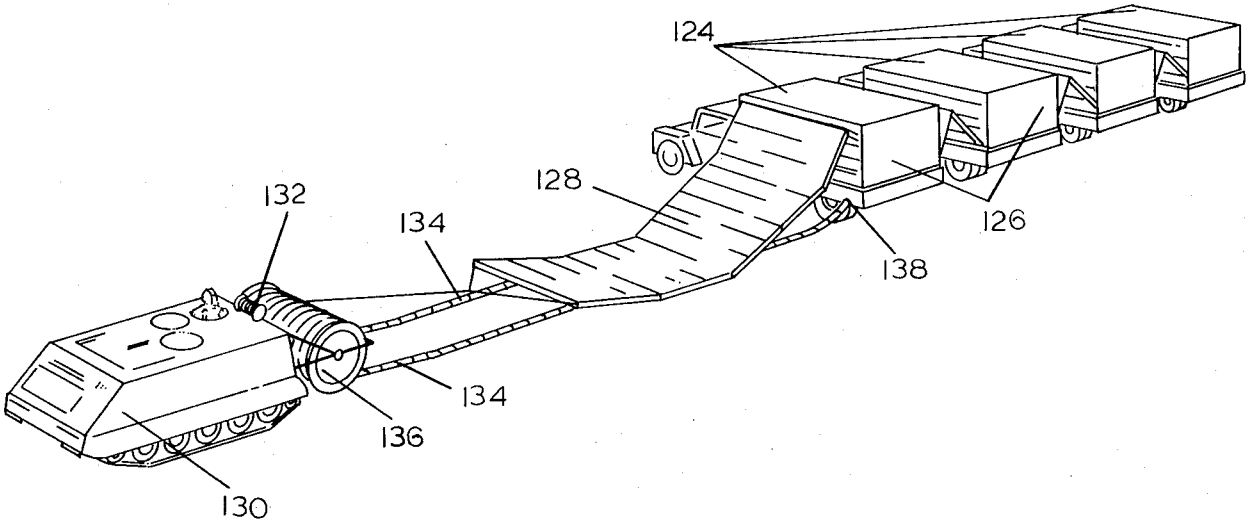
FIG. 18 is a sketch showing a scheme for laying long lengths of the surfacing in a roadway.

In FIG. 18, there is shown one scheme for deploying long lengths of the surfacing of the instant invention in a roadway. Therein are shown four trucks 124, which have pallets 126 placed thereon; the surfacing would be hung by suitable hanger means in the pallets in lengths of three planks instead of one plank in the case of the pallet shown in FIGS. 10 and 11. The trucks 124 are parked side by side, and the sides of the pallet are removed in order that the surfacing 128 can be joined between the various pallets. The surfacing from the nearest truck 124 is connected to a winch 132 on a tow vehicle 130. Also, on the tow vehicle is a twin reel 136, which will dispense hoses 134 over which the surfacing 128 would be deployed or dragged. The hoses are inflated with air from tanks of compressed air (not shown), which could be mounted under truck 124. Pressure regulators would reduce the air pressure to the proper pressure for the hose. After deployment of the surfacing is finished, the hoses are cut, allowing the total hose length to deflate for trafficing the roadway. This allows the long section of surfacing weighing up to 100,000 pounds to be deployed with a low coefficient of friction but, when the hose is deflated, to provide a high fixity between the surfacing and subgrade.

Advantageous embodiments of the invention have been shown and described, and it is obvious that various changes and modifications can be made therein without departing from the appended claims.

We claim:

1. A transportable modular surfacing system comprising:

a plurality of rectangularly shaped planks, each of said planks having a first long side provided with a male portion and a second long side provided with a female portion, said male and female portions of adjacent planks being interengagable;

an elongated passage extending along the length of each of said long sides of each of said planks and being generally parallel to said male and female portions;

flexible continuous hinge members joining adjacent ones of said planks to each other to form said surfacing system, each of said hinge members having a generally rectangular base portion with first and second bulb portions extending along first and second long sides of said base portion, said first bulb portion of each of said hinge members being removably positionable within said elongated passage adjacent said male portion of a first of said planks and said second bulb portion of each of said hinge members being removably positionable within said elongated passage adjacent said female portion of a second adjacent one of said planks, said hinge member being connectable to said adjacent planks when said planks lie in intersecting planes thereby joining said adjacent planks so that said planks may be folded in an accordion fashion, said flexible continuous hinge members preventing the penetration of water, and the pumping of mud from beneath said modular surfacing and between said adjacent planks during traversal of said modular surfacing system by vehicles when said planks are positioned in substantially the same plane to form said surfacing system; and, hinge retainer means secured in said elongated passages and abutting the ends of said bulb portions of said flexible continuous hinge members to prevent lateral shifting of adjacent ones of said planks in said surfacing system.

2. The surfacing system of claim 1 further including a pallet for use in storing and transporting said surfacing system while folded in said accordion fashion, and means for deploying said planks from said pallet to form said surfacing system.

3. The surfacing of claim 1 wherein each of said planks is formed of aluminum extrusion sections, said sections containing parallel hollow conduit portions extending the length of said long sides of each of said planks.

4. The surfacing system of claim 3 further including removable closures for plugging said hollow conduit portions of said planks thereby allowing said surfacing system to float.

5. The surfacing system of claim 1 further including spade members on the surface engaging portion of end ones of said planks, said spade members anchoring said system to the surface on which the surfacing system is deployed.

* * * * *